US008087595B1

(12) United States Patent
Freese

(10) Patent No.: US 8,087,595 B1
(45) Date of Patent: Jan. 3, 2012

(54) COMBINATION RINSE PITCHER AND SHOWER SPOUT

(75) Inventor: Lawrence O. Freese, Santa Rosa Beach, FL (US)

(73) Assignee: BRICA, Inc., Charlotte, NC (US)

( * ) Notice: Subject to any disclaimer, the term of this patent is extended or adjusted under 35 U.S.C. 154(b) by 179 days.

(21) Appl. No.: 12/732,898

(22) Filed: Mar. 26, 2010

Related U.S. Application Data

(60) Provisional application No. 61/164,967, filed on Mar. 31, 2009.

(51) Int. Cl.

| | |
|---|---|
| ***B05B 1/14*** | (2006.01) |
| ***A01G 25/14*** | (2006.01) |
| ***B65D 25/40*** | (2006.01) |
| ***A45D 19/00*** | (2006.01) |
| ***A45D 19/02*** | (2006.01) |

(52) U.S. Cl. ..... 239/377; 239/289; 239/376; 239/559; 239/567; 222/465.1; 222/566; 222/570; 4/515; 4/520

(58) Field of Classification Search ..... 239/193, 239/289, 375–377, 559, 567; 222/189.07, 222/206, 210, 214, 215, 465.1, 566, 567, 222/569, 570, 572; 4/515–518, 520, 521, 4/523, 602; 220/9.4, 608, 609, 669, 904
See application file for complete search history.

(56) References Cited

U.S. PATENT DOCUMENTS

| | | | | |
|---|---|---|---|---|
| 617,973 | A * | 1/1899 | Sulzbacher | 222/189.07 |
| 5,960,987 | A * | 10/1999 | Solland et al. | 220/834 |
| 6,164,488 | A * | 12/2000 | Solland et al. | 220/834 |
| 6,520,383 | B1 * | 2/2003 | Brest | 222/189.07 |
| 7,441,675 | B2 | 10/2008 | McGinley et al. | |
| 2004/0149783 | A1 | 8/2004 | McGinley et al. | |
| 2009/0032551 | A1 | 2/2009 | McGinley et al. | |
| 2009/0045229 | A1 | 2/2009 | McGinley et al. | |

OTHER PUBLICATIONS

Munchkin Shampoo Rinser web page, http://www.munchkin.com/products/detail.html?pID=1257&section=&ID=&li=1, date unknown.

* cited by examiner

*Primary Examiner* — Darren W Gorman
(74) *Attorney, Agent, or Firm* — Carter & Schnedler, P.A.

(57) ABSTRACT

A combination rinse pitcher, particularly for rinsing shampoo from the head of a child during "bath time." A main container body is made of relatively rigid material, and has a bottom and a plurality of main body sidewalls. A lip element is attached to the main container body and defines a rim of the rinse pitcher. The lip element is made of a relatively soft material which is sufficiently flexible such that at least a first portion of the rim can conform to the shape of the child's forehead. The first portion of the rim can be pressed against the child's forehead forming a seal to prevent poured water from flowing down the forehead of the child. A second one of the lip element sidewalls has apertures through which water can be poured to provide a shower-like flow.

5 Claims, 5 Drawing Sheets

COMBINATION RINSE PITCHER AND SHOWER SPOUT

CROSS-REFERENCE TO RELATED APPLICATION

The benefit of U.S. provisional patent application Ser. No. 61/164,967, filed Mar. 31, 2009, is claimed.

BACKGROUND OF THE INVENTION

The invention relates generally to rinse pitchers for rinsing the hair of a child during "bath time." Examples are disclosed in McGinley et al U.S. Pat. No. 7,441,675, and in McGinley et al patent application Pub. Nos. US 2009/0032551 and US 2009/0045299.

SUMMARY OF THE INVENTION

A rinse pitcher is provided, particularly for rinsing shampoo from the head of a child having a forehead. The rinse pitcher includes a main container body of relatively rigid material, the main body having a bottom, and a plurality of main body sidewalls. A lip element is attached to the main container body and defines a rim of the rinse pitcher. The lip element has a corresponding plurality of lip element sidewalls and is made of a relatively soft material which is sufficiently flexible such that at least a first portion of the rim can conform to the shape of the child's forehead. At least a first one of the lip element sidewalls has an extent sufficient to span the forehead of the child such that the first portion of the rim can be pressed against the child's forehead forming a seal to prevent poured water from flowing down the forehead of the child. A second one of the lip element sidewalls has apertures through which water can be poured to provide a shower-like flow.

DETAILED DESCRIPTION

Figure 1:
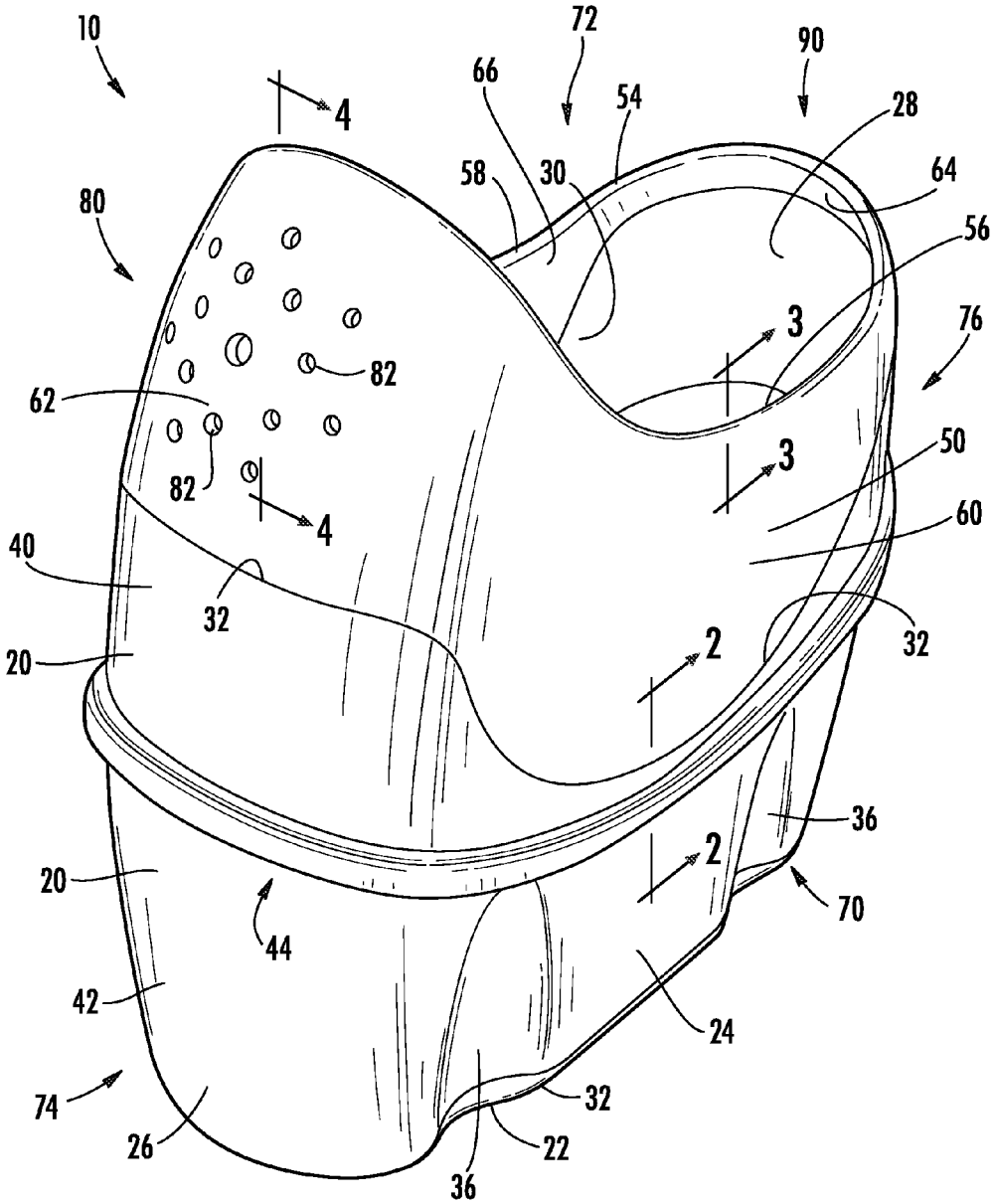
FIG. 1 is a three-dimensional illustration of a combination rinse pitcher and shower spout embodying the invention.
Figure 5:
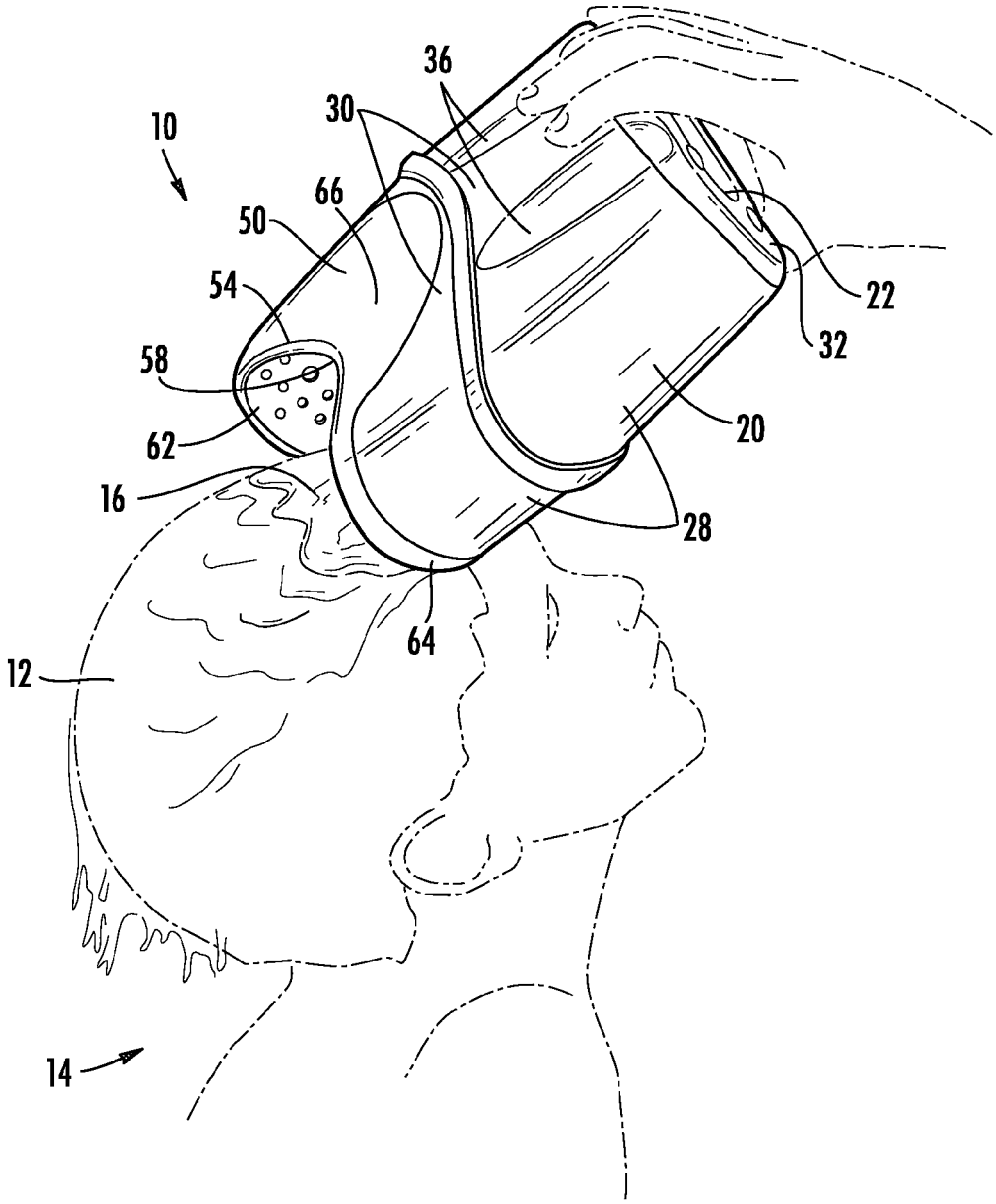
FIG. 5 illustrates the combination rinse pitcher and shower spout of FIG. 1 in use in a forehead-contact rinse mode.
Figure 6:
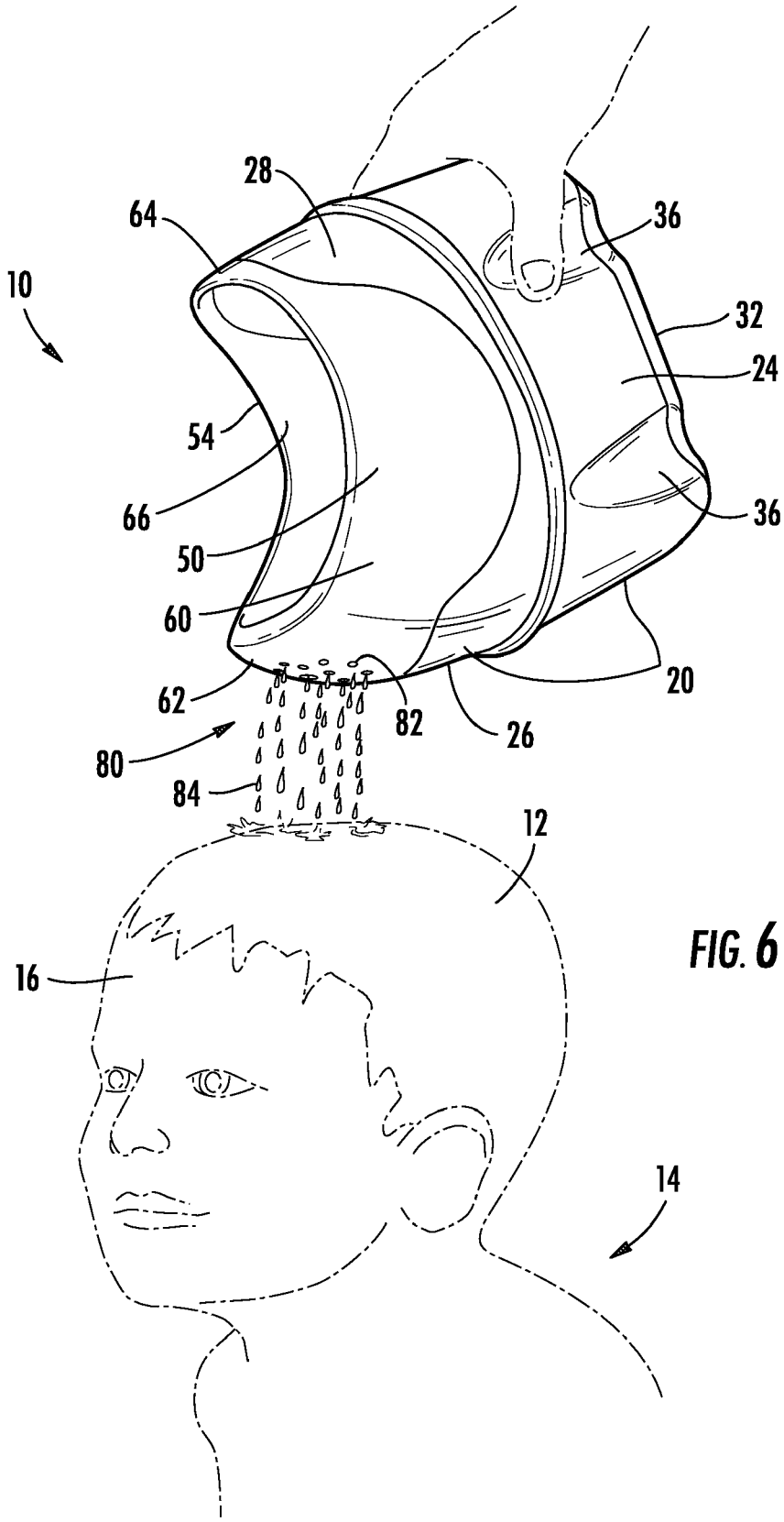
FIG. 6 illustrates the combination rinse pitcher and shower spout during use in a shower spout rinse mode.
Figure 7:
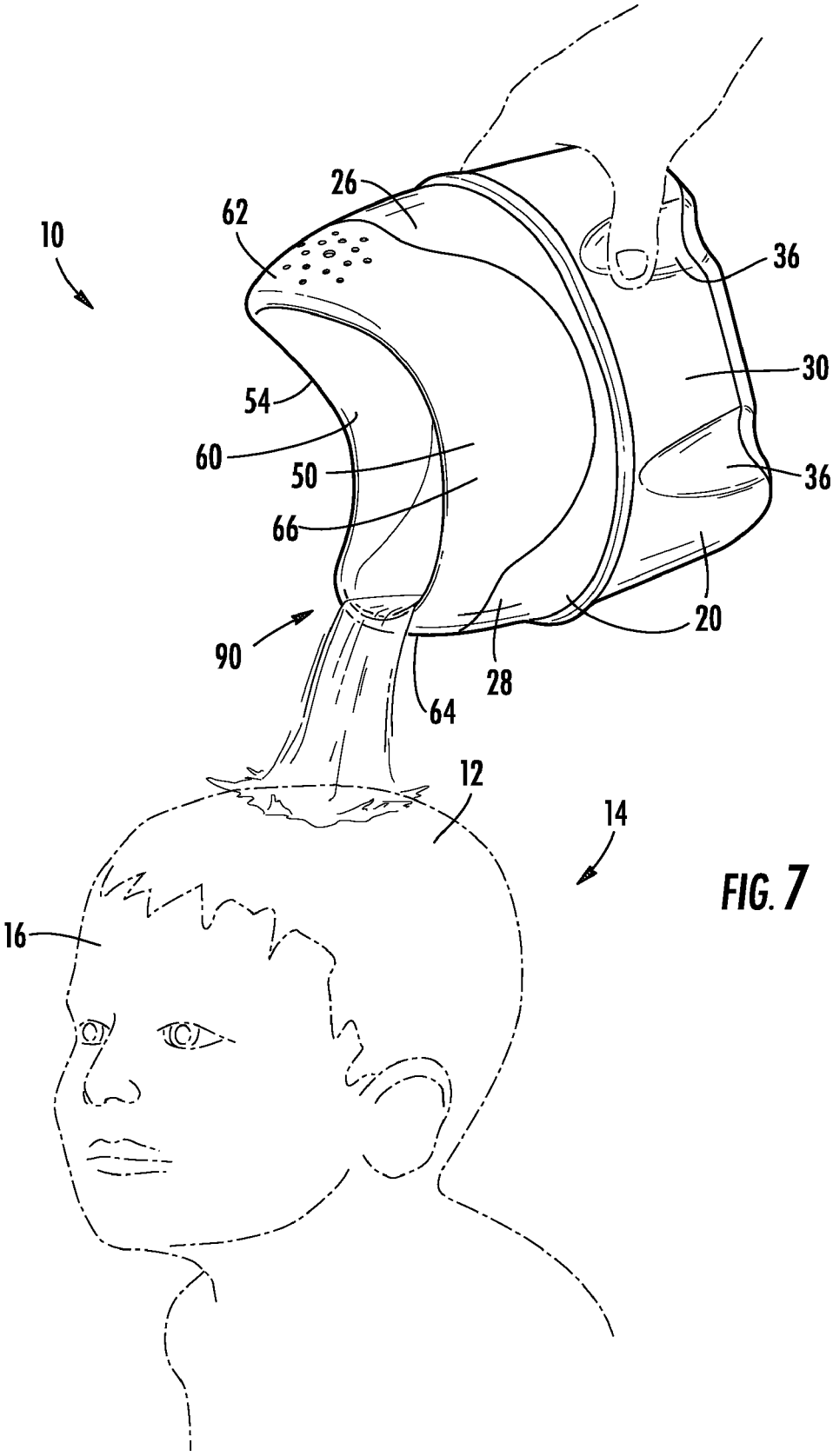
FIG. 7 illustrates the rinse pitcher and shower spout during use in a pour spout rinse mode.

Referring first to FIG. 1, a combination rinse pitcher and shower spout device embodying the invention is generally designated 10, and, for purposes of description, referred to hereinbelow as a rinse pitcher 10. Referring also to FIGS. 5, 6 and 7, described hereinbelow in greater detail, the pitcher 10 is particularly adapted for rinsing shampoo, or other hair treatment, from the head 12 of a child represented at 14 having a forehead 16.

The rinse pitcher 10 includes a main container body 10 of a relatively rigid material, so that the body 20 does not unduly deform when grasped. Preferably, the main container body 20 is made of a relatively rigid or hard plastic material, such as polypropelene.

The main container body 20 has a bottom 22, and four main body sidewalls, a first main body sidewall 24, a second main body sidewall 26, a third main body sidewall 28 and a fourth main body sidewall 30. The sidewalls 24, 26, 28 and 30 terminate in a top edge 32 of the body 20. For ease of gripping, the main container body 20 includes a plurality of indentations 34. A rubbery non-skid bottom surface 36 is provided, which may be provided as a thin layer 36 of material on the underside of the main container body 20. A suitable material for the non-skid layer 36 is a thermoplastic elastomer (TPE).

To facilitate manufacturing by plastic injection molding, the main container body 20 is made in two parts, a top part 40 and a bottom part 42 continuously joined in an almost water-tight manner along a joint structure 44.

Figure 2:
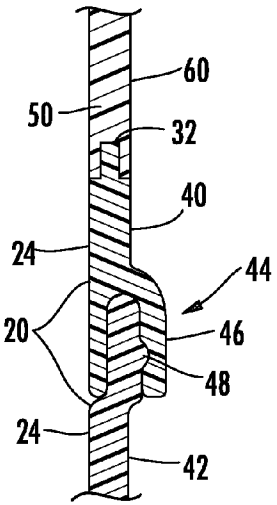
FIG. 2 is a cross-sectional view taken on line 2-2 of FIG. 1.

With particular reference to the cross-sectional view of FIG. 2, in the illustrated embodiment the joint structure 44 includes an inverted "U" structure 46 formed as part of the main body top part 40. The inverted "U" structure 46 snaps onto a bottom locking structure 48 formed as part of the main body bottom part 42.

With reference again to FIG. 1, the rinse pitcher 10 additionally includes a lip element 50 attached to the top edge 32 of the main container body 20, and defining a rim 54 of the rinse pitcher 10. The lip element 50 is made of a relatively soft material so that the lip element 50 can deform and so that at least a first portion 56 of the rim 54 can conform to the shape of the child's forehead 16, particularly when used in the forehead-contact rinse mode of FIG. 5. The material of the lip element 50 is softer and more flexible relative to the material of the main container body 20. As a particular example, the lip element 50 may be made of a rubbery material, such as a thermoplastic elastomer (TPE). In the illustrated embodiment, a fourth portion 58 of the rim 54, opposite the first portion 56, can as well conform to the shape of the child's forehead 16.

The lip element 52 more particularly has a plurality of lip element sidewalls, a first lip element sidewall 60 terminating in the first portion 56 of the rim 54, a second lip element sidewall 62, a third lip element sidewall 64 and a fourth lip element sidewall 66 terminating in the fourth portion 58 of the rim 54, corresponding to the main body sidewalls 24, 26, 28 and 30, respectively.

Referring again to the cross-section of FIG. 2, the TPE lip element 50 is permanently bonded to the polypropelene main container body 20 employing an over mold process. Thus the top 40 and bottom 42 parts of the main body 20 are formed by injection molding. A second mold is employed which receives the already-molded top part 40 of the main body 20, and in addition defines the shape of the lip element 50. (The non-skid bottom layer 36, also made of a TPE, is similarly formed on and bonded to the bottom part 42 of the main body 20.)

To efficiently utilize space and to conveniently fit on the sides of many bathtubs, the rinse pitcher 10 is generally rectangular in configuration (but with rounded ends) having a length of approximately seven inches, and a width of approximately three and three-eighths inches. The rubbery non-skid bottom surface layer 36 aids in retaining the rinse pitcher 10 on the sides of a bathtub.

Accordingly, the first and fourth main body sidewalls 24 and 30, as well as the corresponding first and fourth lip element sidewalls 60 and 66 are of relatively greater extent to generally define sides 70 and 72 of the rinse pitcher 10. The second and third main body sidewalls 26 and 28 and corresponding second and third lip element sidewalls 62 and 64 are of relatively lesser extent compared to the sidewalls 24, 30, 60 and 66, to generally define ends 74 and 76 of the rinse pitcher 10. In the illustrated embodiment, the ends 74 and 76 are rounded.

In the illustrated embodiment, the first and fourth lip element sidewalls 60 and 66 have an extent sufficient to span the forehead 16 of the child 14 such that the first portion 56 of the rim 54 can be pressed against the child's forehead 16, forming a seal, to prevent poured rinse water from flowing down the forehead 16, as is illustrated in FIG. 5. The opposite fourth portion 58 of the rim 54 can be employed in the same manner.

Figure 3:
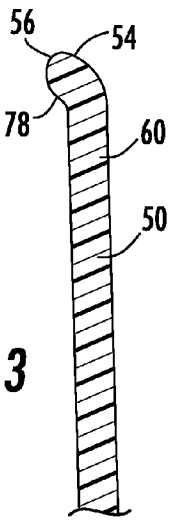
FIG. 3 is a cross-sectional view taken on line 3-3 of FIG. 1.

With reference to the cross-sectional view of FIG. 3, the rim 54 of the lip element 50 has a small rounded return 78 or flange 78 which defines first and fourth portions 56 and 58 of the rim 54 at the top of the first and fourth sidewalls 60 and 66. The rounded flange 78 is sufficient to provide comfort and a sealing function against the child's forehead 16.

Figure 4:
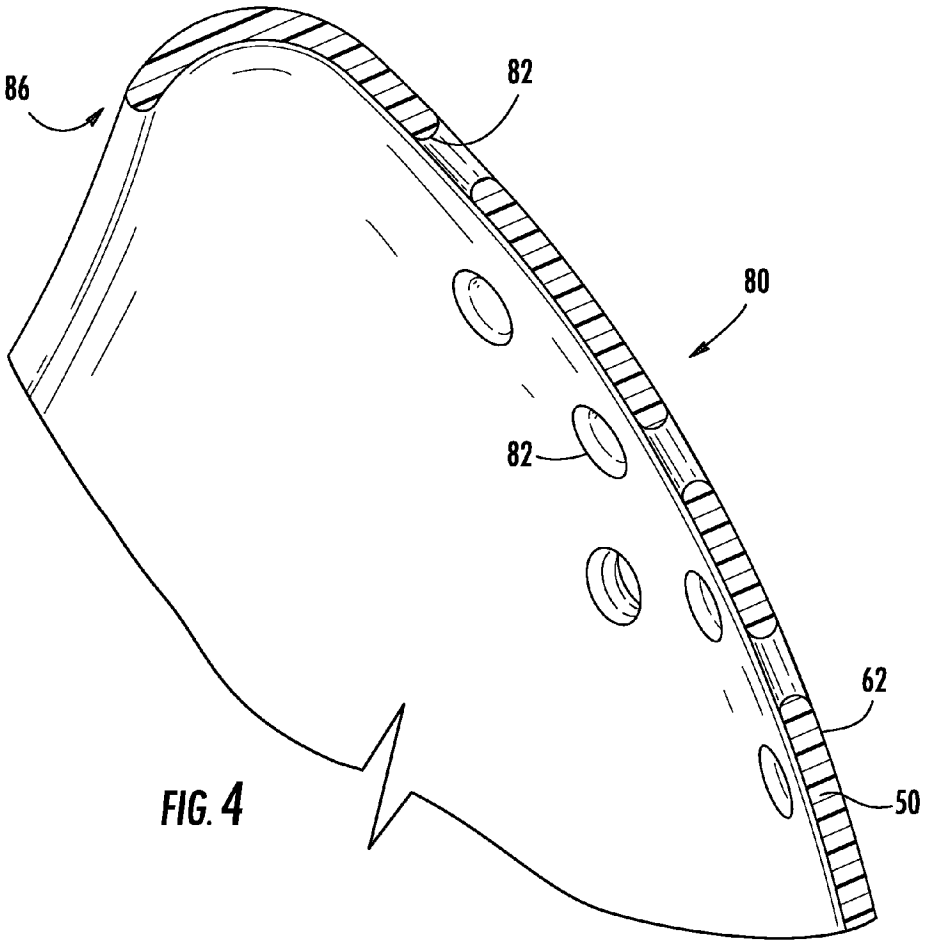
FIG. 4 is a cross-sectional view taken on line 4-4 of FIG. 1.

The second lip element sidewall 62 is slightly taller than the other sidewalls 60, 64 and 66, and functions as a shower element 80, as is particularly illustrated in FIG. 6, for rinsing as well as for fun and play. Accordingly, the shower element 80 portion of the second lip element sidewall 62 has apertures 82 through which water can be poured to provide a shower-like flow, somewhat like a sprinkling can. Water droplets 84 are illustrated coming out of the apertures 82. To avoid undesired spilling of water during use in the FIG. 6 shower spout mode, and with particular reference to the cross-sectional view of FIG. 4, the rim at the top of the second lip element sidewall 62 has a relatively larger rounded return 86 or flange 86.

The third lip element sidewall 64 is configured as a pour spout 90, the use of which is illustrated in FIG. 7.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A rinse pitcher particularly for rinsing shampoo from the head of a child having a forehead, said pitcher comprising:

a main container body of relatively rigid material, said main body having a bottom, and a plurality of main body sidewalls;

a lip element attached to said main container body and defining a rim of said rinse pitcher, said lip element having a corresponding plurality of lip element sidewalls and being made of a relatively soft material which is sufficiently flexible such that at least a first portion of said rim can conform to the shape of the child's forehead;

at least a first one of said lip element sidewalls having an extent sufficient to span the forehead of the child such that said first portion of said rim can be pressed against the child's forehead forming a seal to prevent poured water from flowing down the forehead of the child; and a second one of said lip element sidewalls having apertures through which water can be poured to provide a shower-like flow.

2. The rinse pitcher of claim 1, wherein said second one of said lip element sidewalls has an extent less than that of said first lip element sidewalls.

3. The rinse pitcher of claim 1, wherein a third one of said lip element sidewalls has an extent less than that of said first lip element sidewalls, and is configured as a pour spout.

4. The rinse pitcher of claim 1, wherein:

said lip element has four sidewalls arranged in a generally rectangular configuration; wherein said first one of said lip element sidewalls and a fourth one of said lip element sidewalls are of equal and relatively greater extent to generally define sides of said rinse pitcher; and wherein said second one of said lip element sidewalls and a third one of said lip element sidewalls are of equal and relatively lesser extent to generally define ends of said rinse pitcher.

5. The rinse pitcher of claim 3, wherein:

said lip element has four sidewalls arranged in a generally rectangular configuration; wherein said first one of said lip element sidewalls and a fourth one of said lip element sidewalls are of equal and relatively greater extent to generally define sides of said rinse pitcher; and wherein said second one of said lip element sidewalls and said third one of said lip element sidewalls are of equal and relatively lesser extent to generally define ends of said rinse pitcher.

* * * * *